US006255608B1

(12) United States Patent
Kawata et al.

(10) Patent No.: US 6,255,608 B1
(45) Date of Patent: Jul. 3, 2001

(54) TERMINAL STRUCTURE OF SWITCH

(75) Inventors: Hisao Kawata; Naoshi Uchida; Katsunori Kuboyama; Tatsunori Takahashi, all of Kanagawa (JP)

(73) Assignee: Fuji Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/503,518

(22) Filed: Feb. 14, 2000

(30) Foreign Application Priority Data

Feb. 15, 1999 (JP) ..... 11-035559

(51) Int. Cl.[7] ..... H01R 13/70

(52) U.S. Cl. ..... 200/51 R; 200/447

(58) Field of Search ..... 200/303, 284, 200/534, 447, 51 R

(56) References Cited

U.S. PATENT DOCUMENTS 4,016,387 * 4/1977 Aberer ..... 200/303
4,103,124 * 7/1978 Reis ..... 200/51 R
4,209,677 * 6/1980 Brown ..... 200/67 D
4,218,108 * 8/1980 El Moucho ..... 339/82
5,001,316 * 3/1991 Salaman ..... 200/527
5,812,041 * 9/1998 Ishikawa et al. ..... 335/126

* cited by examiner

*Primary Examiner*—Michael L. Gellner
*Assistant Examiner*—Nhung Nguyen
(74) *Attorney, Agent, or Firm*—Pearne & Gordon LLP

(57) ABSTRACT

In a terminal structure of a switch which is arranged in a manner that a terminal conductor 14 with a terminal screw drawn from the inner portion of the casing is disposed at every phase in the terminal portion of a casing formed by the three-divided structure of an upper cover 2, an intermediate cover 3 and a lower cover, and wires inserted into the terminal portion from the outside are respectively fastened by the screws to be coupled to the terminal conductors, the terminal conductors of the respective phases are pressed into the terminal fixing grooves 3*b* formed at the intermediate cover and fixed to the casing in a manner that the left and right side edges of each of the terminal conductors are pressed into the grooves. The terminal conductor of each phase is surrounded by a side wall 2*a* and an inter-phase partition wall 2*b* formed at the upper cover, and the fitting portion of the upper cover and the intermediate cover is defined at a portion lower than the terminal conductors thereby to enlarge the width of a space into which wires are inserted. Further, step portions 3*b*-1 are formed at portions of the terminal fixing grooves so that two kinds of terminal conductors having different plate thickness can be selectively assembled in the intermediate cover.

4 Claims, 3 Drawing Sheets

TERMINAL STRUCTURE OF SWITCH

BACKGROUND OF THE INVENTION

1. Field of the Invention

The present invention relates to a terminal structure of a switch to be applied to a molded case circuit breaker, an electromagnetic contactor etc.

2. Description of the Related Art

The assembled structure of a conventional switch (for three-phase) which is applied to the aforesaid molded case circuit breaker is shown in FIG. 4. In the figure, a reference numeral 1 denotes a casing (resin casing) of three-divided structure formed by combining an upper cover 2, an intermediate cover 3 and a lower cover 4 in a fitting manner. A reference numeral 5 denotes a fixed contact shoe incorporated in the breaker portion of the casing 1, 6 a movable-contact shoe, 7 an arc-extinguishing plate, 8 a switching mechanism, 9 an operation handle and 10 an over current tripping device. A terminal portion 11 on power supply side and a terminal portion 12 on load side are formed at the front end and the rear end of the casing 1, respectively. The terminal portions 11 and 12 are provided with terminal conductors 13 and 14 drawn from the inner portion of the casing at every phase and also provided with terminal screws 15 engaged with the terminal conductors 13 and 14, respectively. Each of the terminal portions is partitioned at every phase by partition walls formed at the casing 1. Each of the terminal conductors 14 of load side is integrated with the fixed contact shoe and fixedly held at the intermediate cover 3 in a bent configuration of S-shape as shown in FIGS. 2A and 2B. In FIGS. 2A and 2B, a reference numeral 14*a* denotes a fixed contact, 14*b* an arc horn and 14*c* a wire connection portion drawn to the terminal portion 12.

The conventional structure of the upper cover 2 of the aforesaid cover 1 and the intermediate casing 3 which supports the terminal conductors 14 of load side are shown in FIGS. 5A and 5B. That is, the intermediate cover 3 is provided with partition walls 3*a* which elect upward so as to surround the wire connection portions 14*c* of the terminal conductors 14 of the respective phases drawn to the terminal portion and the terminal screws 15 (see FIG. 4). The terminal portion of the power supply side is configured in the same manner.

The intermediate cover 3 is also provided with terminal fixing grooves 3*b* which are formed at the right and left walls of the drawing path of each of the terminal conductors 14 of load side so as to extend along the drawing path, respectively. Each of the terminal conductors 14 is fixed to the intermediate cover in a manner that a lug portion extended from the left and right side edges of the terminal conductor 14 (the width of the conductor of the lug portion is W) is pressed into the corresponding terminal fixing grooves 3*b* from the forward direction and fixed and held at the assembling position. In the example shown in the drawings, the groove width of the terminal fixing groove 3*b* corresponds to the plate thickness T of the terminal conductor 14 shown in FIG. 2A, and the length of the terminal fixing groove is set so as to coincide with the length R of the lug portion shown in FIG. 2B.

The upper cover 2 is fitted and coupled on the intermediate cover 3 as shown in the drawings in a manner that, at this position, the side walls 2*a* of the upper cover 2 are overlapped on the outsides of the partition walls 3*a* elected from the left and right ends of the intermediate cover 3, respectively.

In a switch such as a circuit breaker or the like, it has been intended to increase the capacity while using the casing of the same frame size in order to miniaturize the size of the outer configuration, unify the type and reduce the managing processes of the designing and manufacturing procedures thereof. In this point of view, the conventional structure of the aforesaid terminal portion remains the following problems.

(1) According to the conventional switch, there has such a structure that the partition walls 3*a* elected upward from the intermediate cover 3 are respectively formed so as to surround the corresponding terminal conductors 14 drawn to the terminal portion for the respective phases and the upper cover 2 is fitted to the partition walls 3*a* from the outside. Accordingly, a space for inserting the wires into the terminal portion from the outside is limited by the partition walls. That is, the thickness of the side walls 2*a* and the partition walls 3*a* is required to be larger to some extent in order to secure the mechanical strength of the upper cover 2 and the intermediate cover 3. However, in a case of setting the thickness of the side walls 2*a* and the partition walls 3*a* to predetermined values, respectively, so as to make the size of the entire outer configuration of the casing within a predetermined value, the width $V_2$ of a space for inserting a wire therein is inevitably restricted and becomes narrow.

Thus, when the casing having the conventional structure is still used, in a case where the casing for a switch with a smaller current capacity is also used as the casing for a switch with a larger current capacity, there arises a problem in use that a thick wire can not be inserted and connected from the outside.

(2) Further, although it is necessary to make the plate thickness of the terminal conductor larger in a switch specified to have a large current capacity, the terminal fixing grooves 3*b* of the intermediate cover 3 for fixing the terminal conductor 14 are arranged to have the same groove width along the entire length thereof in .he conventional casing. Accordingly, when the terminal conductor has a thickness larger than the groove width, the terminal conductor can not be pressed into and fixed to the terminal fixing groove 3*b* unless the terminal conductor is subjected to such a processing that the left and right side edges thereof are made flat, for example.

SUMMARY OF THE INVENTION

The present invention has been made in view of the aforesaid matters and an object of the present invention is to provide the terminal structure for a switch which can obviate aforesaid conventional problems and is improved so as to be able to cope with the enlargement of the specification of the rated current without changing the frame size thereof.

In order to attain the aforesaid object, according to a first aspect of the present invention, in the terminal structure of a switch which is arranged in a manner that a terminal portion whose respective phase spaces are partitioned by partition walls is defined at the end portion of a casing of three-divided structure formed by fitting an upper cover, an intermediate cover and a lower cover, a terminal conductor with a terminal screw drawn from a breaker portion within the casing is disposed at every phase in the terminal portion, and wires inserted into the terminal portion from outside are fastened by the screws to be coupled to the terminal conductors, respectively, (1) a fitting portion of the upper cover and the intermediate cover is defined at a portion lower than an upper surface of the terminal conductors drawn to the terminal portion, and the terminal conductors drawn to the terminal portion and the terminal screws are surrounded by the partition walls formed at the upper cover.

As described above, since the walls for surrounding the terminal portion are formed only at the upper cover and the partition walls elected upward from the intermediate cover are eliminated, the space into which wires are inserted from the outside is enlarged as compared with the conventional double wall structure and hence thicker wires can be connected. As a result, the terminal structure according to the present invention can easily cope with the enlargement of the specification of the rated current without changing the frame size thereof.

According to a second aspect of the present invention, in the aforesaid terminal portion, (2) left and right side edges of each of the terminal conductors laid between the terminal portion and the breaker portion are pressed into terminal fixing grooves formed on the intermediate cover side from forward direction to hold the terminal conductors at an assembling position, wherein each of the terminal fixing grooves is formed to have a step portion which divides the groove into a former half area and a latter half area along a longitudinal direction thereof in a manner that the width of the groove in the former half area thereof is made coincide with the terminal conductor with a large thickness and the width of the groove in the latter half area thereof is made coincide with the terminal conductor with a thin thickness, and the terminal conductor with the large thickness is formed to have a narrow width in the latter half area thereof.

According to the aforesaid arrangement, the terminal conductor with a thin thickness inserted into the terminal fixing grooves from the forward direction is fixed in manner that the side edges of the terminal conductor are fixed at the latter half area with the narrow groove width, and the terminal conductor with the large thickness is fixed at the former half area with the enlarged groove width. Accordingly, it becomes possible to incorporate two kinds of terminal conductors with different plate thickness in the casing of the same frame size, whereby the terminal structure according to the present invention can easily cope with the enlargement of the specification of the rated current.

BRIEF DESCRIPTION OF THE DRAWINGS

FIG. 3C is a front view of the terminal conductor in a state where the terminal conductor is assembled to the terminal portion of the intermediate cover.

DETAILED DESCRIPTION OF THE PRESENT INVENTION

Figure 3A:
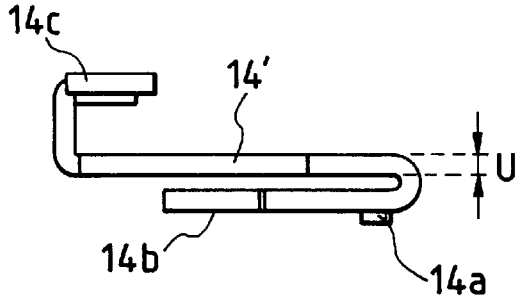
FIGS. 3A to 3C are a side view and a rear view of the terminal conductor, respectively, representing the arrangement of the terminal conductor having a large plate thickness to be applied to the terminal portion of FIG. 1.
Figure 3B:
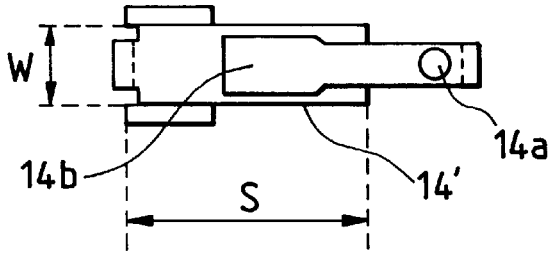
Figure 3C:
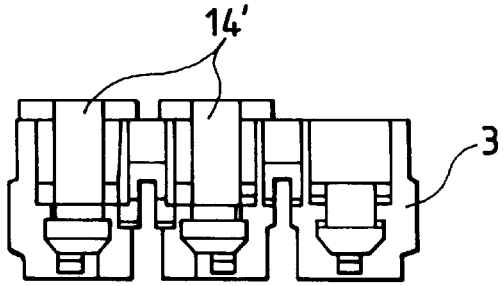
Figure 4:
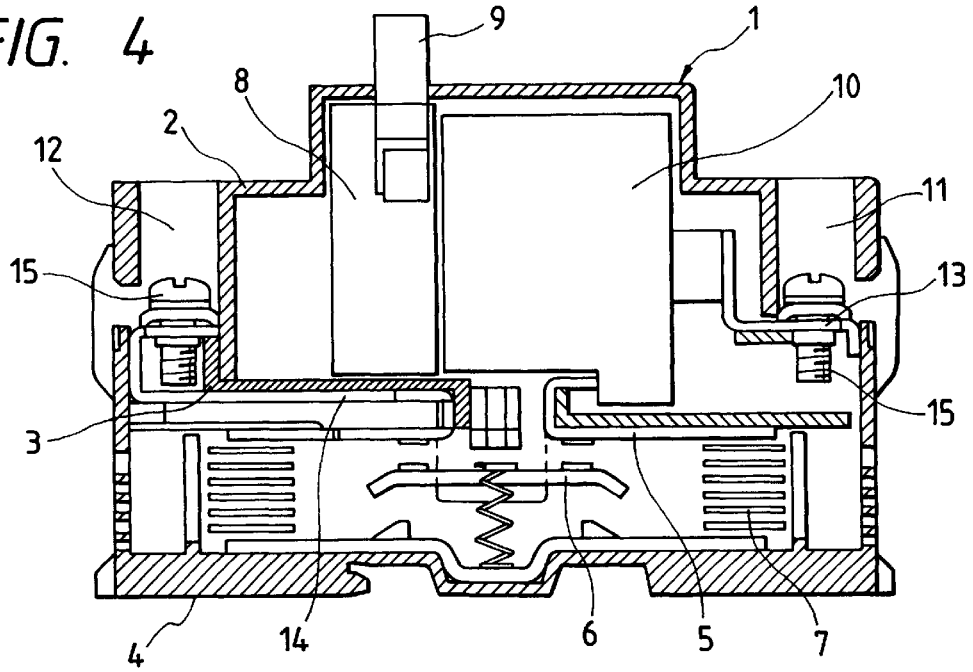
FIG. 4 is a sectional diagram showing the entire configuration of a switch to which the present invention is applied.
Figure 5A:
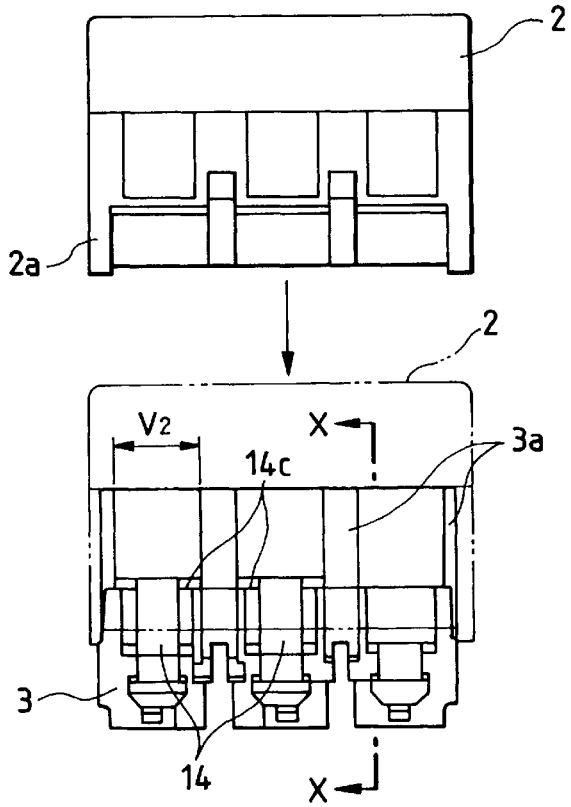
FIG. 5A is a front view showing a state where an upper cover and an intermediate cover are separated in the conventional terminal portion of FIG. 4.
Figure 5B:
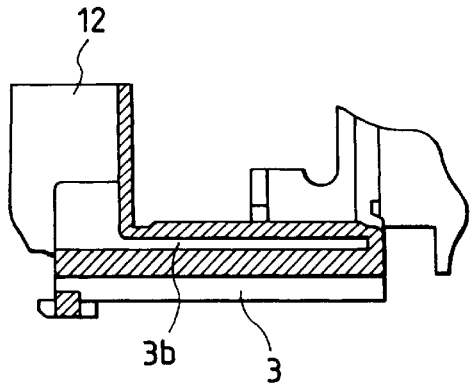
FIG. 5B is a sectional diagram cut along a line X—X in FIG. 5A in the conventional terminal portion of FIG. 4.

The embodiment of the present invention will be explained with reference to FIGS. 1A to 3C. In the figures showing the embodiment, like parts corresponding to those of FIGS. 4 and 5A and 5B are marked with the same references and the explanation thereof is omitted First, in FIGS. 1A to 1C, the terminal portion of an intermediate cover 3 holding terminal conductors 14 is configured in a manner that an upper surface of the intermediate cover 3 is flat and no partition wall 3*a* elected from the intermediate cover 3 as shown in FIG. 5 is formed. Inter-phase partition walls 2*b* for the respective phases are formed only on an upper cover 2 side so as to surround the terminal conductors 14 and terminal screws 15 in combination with side walls 2*a*. In an assembled state where the upper cover 2 is fitted on the intermediate cover 3 as shown by a dotted line in FIG. 1A, the terminal portion is set in a manner that the left and right side surfaces of the intermediate cover 3 fit to the left and right side walls 2*a* of the upper cover 2 fit respectively (the fitted range is represented by L) at the position lower than a height position H of wire connecting portions 14*c* of the terminal conductors 14 attached to the intermediate cover 3.

According to such a configuration, in the assembled state where the upper cover 2 is fitted on the intermediate cover 3, a space for inserting the wire to be connected to the terminal conductor 14 is defined between the side wall 2*a* of the upper cover 2 and the partition wall 2*b* so as to have a space width $V_1$, which is larger than the space width $V_2$ of the double wall structure shown in FIG. 5A. That is, it is possible to insert a wire which is thicker by one rank into the space as compared with the conventional space. For example, when a molded case circuit breaker is arranged to have a rated current of 25A and a casing main body width of 45 mm, the maximum thickness of a wire capable of being connected to the breaker is 6 $mm^2$ in the casing of the conventional structure shown in FIGS. 5A and 5B, while the maximum thickness of a wire capable of being connected to the breaker is 10 $mm^2$ the casing of the embodiment shown in the figure.

Each of the terminal fixing grooves 3*b* formed at the intermediate cover 3 is provided with a step portion 3*b*-1 at a portion thereof along the longitudinal direction thereof so as to divide the groove into a latter half area and a former half area. Each of the terminal fixing grooves is arranged in a manner that the width of the groove at the latter half area Q is set to be narrow so as to coincide with the plate thickness T of the terminal conductor 14 shown in FIG. 2A and 2B. The width of the groove at the form r half area P is set to be large so as to coincide with the plate thickness U of a terminal conductor 14' with a large thickness shown in FIGS. 3A and 3B. In the terminal conductor 14 shown in FIGS. 2A and 2B, the length of the lug portion extended from the left and right side edges which is pressed into the terminal fixing grooves 3*b* is R, while in the terminal conductor 14' shown in FIG. 3, the length of the lug portion is set to a short size S so as to coincide with the length of the terminal fixing groove 3*b* to the step portion 3*b*-1.

Figure 1A:
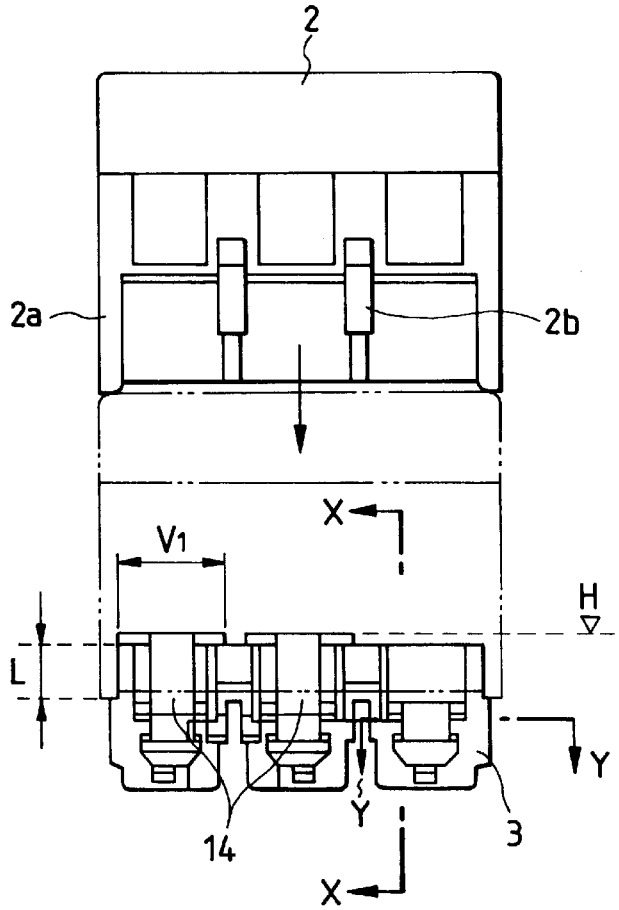
FIG. 1A is a front view of a terminal structure showing a state where an upper cover and an intermediate cover are separated according to the present invention.
Figure 1C:
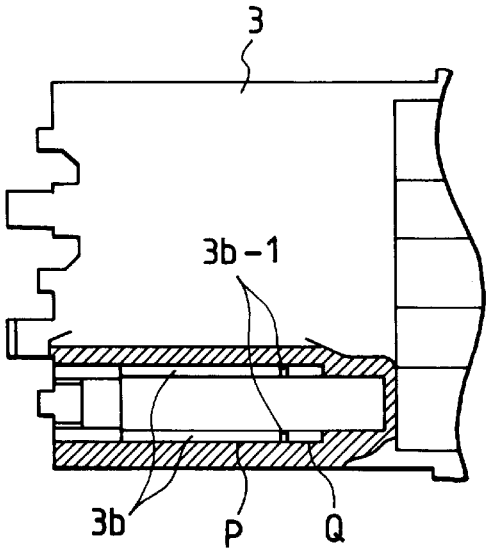
FIGS. 1B and 1C are sectional diagrams cut along lines X—X and Y—Y in FIG. 1A, respectively, according to the present invention.
Figure 1B:
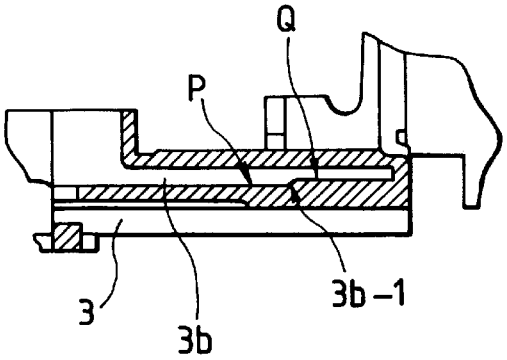
Figure 2A:
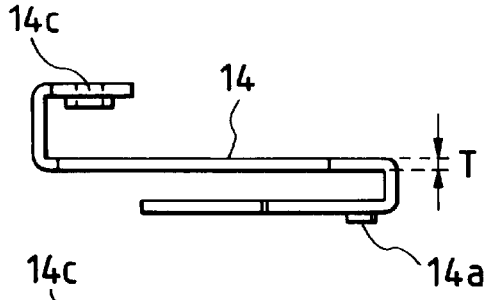
FIGS. 2A and 2B are a side view and a rear view representing the arrangement of the terminal conductor in FIG. 1 according to the present invention, respectively.
Figure 2B:
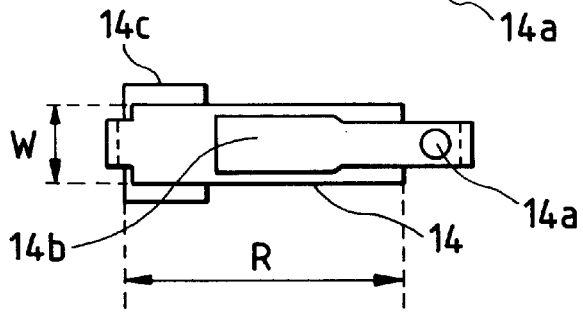

According to such an arrangement, the lug portion extended from the left and right side edges of the terminal conductor 14 having the thin plate thickness shown in FIGS. 2A and 2B is pressed into the latter half area Q having the narrow groove width of the terminal fixing grooves 3*b* of the intermediate cover 3, so that the terminal conductor is fixedly supported by the intermediate casing at the predetermined assembling position shown in FIG. 1A. In contrast, the lug portion of the terminal conductor 14' having the large plate thickness shown in FIG. 3A and 3B is pressed into the former half area P having the large groove width of the terminal fixing grooves 3*b*, so that the terminal conductor is fixedly supported by the intermediate cover at the predetermined assembling position shown in FIG. 3C. In this manner, the two kinds of terminal conductors having different plate thickness can be selectively assembled by employing the intermediate cover 3 in the embodiment shown in the drawings.

Accordingly, when both the aforesaid fitting structure of the upper cover 2 and the intermediate cover 3 and the aforesaid terminal conductor supporting structure are employed, the thickness of the wire capable of being inserted into the terminal portion can be extended from 6 $mm^2$ to 10 $mm^2$ by using the casing 1 of the same outer configuration size, for example, the main body width of 45 mm and by changing the terminal conductor to be assembled into the terminal portion from the terminal conductor 14 having the thin plate thickness to the terminal conductor 14' having the large plate thickness. Thus, the specification of the rated current of the breaker can be enlarged from 25A to 30A.

As described above, the following technical advantages can be attained according to the arrangement of the present invention.

(1) According to the arrangement of the first aspect of the present invention, the width of the space in which the wire to be connected to the terminal portion can be enlarged while the resin casing is set to have a thickness capable of securing the required mechanical strength.

(2) According to the arrangement of the second aspect or the present invention, the two kinds of terminal conductors having different plate thickness can be fixedly supported by the intermediate cover selectively.

Accordingly, when the terminal portion of the switch is configured by using both the arrangements of the first aspect and the second aspect, it becomes possible to provide the switch having high flexibility in the specification such that the terminal structure can be applied to a switch having a larger rated current by one without changing the frame size.

What is claimed is:

1. A terminal structure of a switch comprising:

a casing including an upper cover having a plurality of partition walls, an intermediate cover fitted to the upper cover, and a lower cover fitted to the intermediate cover;

a plurality of terminal conductors each having a terminal screw, the plurality of terminal conductors disposed in the cover, each of the plurality of terminal conductors to be connected by the terminal screw to a wire to be inserted from an outside; and a plurality of breaker portions disposed in the casing, each of the plurality of breaker portions to be connected to each of the plurality of terminal conductors;

wherein each of the terminal conductors and the terminal screws are surrounded by the plurality of partition walls of the upper cover, and a fitting portion of the upper cover and the intermediate cover is defined at a portion lower than an upper surface of the terminal conductors.

2. The terminal structure as claimed in claim 1, wherein the plurality of terminal conductors are disposed in the intermediate cover.

3. The terminal structure as claimed in claim 1, wherein the upper cover has a side wall, each of the terminal conductors and the terminal screws are surrounded by the plurality of partition walls of the upper cover and the side wall.

4. A terminal structure of a switch comprising:

a casing including an upper cover having a plurality of partition walls, an intermediate cover fitted to the upper cover, and a lower cover fitted to the intermediate cover;

a plurality of terminal conductors each having a terminal screw, the plurality of terminal conductors disposed in the cover, each of the plurality of terminal conductors to be connected by the terminal screw to a wire to be inserted from an outside; and a plurality of breaker portions disposed in the casing, each of the plurality of breaker portions to be connected to each of the plurality of terminal conductors;

wherein each of the terminal conductors and each of the terminal screws are surrounded by the plurality of partition walls of the upper cover, a plurality of grooves are defined on the intermediate cover, a left side edge and a right side edge of each of the terminal conductors are pressed from a forward direction into the plurality of grooves to hold the terminal conductors at each assembling position, each of the grooves has a step portion which divides the groove into a former area and a latter area along a longitudinal direction of the groove, a width of the groove in the former area is coincide with the terminal conductor with a large thickness and a width of the groove in the latter area is coincide with the terminal conductor with a thin thickness, and the terminal conductor with the large thickness has a narrow width in the latter area.

* * * * *